US009779659B2

(12) United States Patent
Lin

(10) Patent No.: US 9,779,659 B2
(45) Date of Patent: Oct. 3, 2017

(54) PIXEL ARCHITECTURE AND DRIVING METHOD THEREOF

(71) Applicant: AU OPTRONICS CORP., Hsin-Chu (TW)

(72) Inventor: Chen-Chi Lin, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 43 days.

(21) Appl. No.: 14/613,567

(22) Filed: Feb. 4, 2015

(65) Prior Publication Data

US 2016/0078808 A1 Mar. 17, 2016

(30) Foreign Application Priority Data

Sep. 15, 2014 (TW) ..... 103131780 A

(51) Int. Cl.
*G09G 5/10* (2006.01)
*G09G 3/3233* (2016.01)

(52) U.S. Cl.
CPC ... *G09G 3/3233* (2013.01); *G09G 2300/0819* (2013.01); *G09G 2300/0861* (2013.01); *G09G 2310/0251* (2013.01); *G09G 2310/0256* (2013.01); *G09G 2320/0233* (2013.01); *G09G 2320/043* (2013.01)

(58) Field of Classification Search
CPC ..... G09G 3/3233; G09G 2310/0256; G09G 2300/0861; G09G 2320/043; G09G 2310/0251; G09G 2300/0819; G09G 2320/0233
USPC ..... 345/690
See application file for complete search history.

(56) References Cited

U.S. PATENT DOCUMENTS

| | | | | |
|---|---|---|---|---|
| 8,289,313 | B2 | 10/2012 | Lee et al. | |
| 8,502,757 | B2 | 8/2013 | Liu et al. | |
| 2007/0109232 | A1 | 5/2007 | Yamamoto et al. | |
| 2009/0309516 | A1* | 12/2009 | Kim | G09G 3/3233 315/307 |
| 2011/0109660 | A1* | 5/2011 | Kim | G09G 3/3233 345/690 |

(Continued)

FOREIGN PATENT DOCUMENTS

| | | |
|---|---|---|
| CN | 103489399 | 1/2014 |
| CN | 104167167 A | 11/2014 |

(Continued)

*Primary Examiner* — Adam R Giesy
*Assistant Examiner* — Chineyere Wills-Burns
(74) *Attorney, Agent, or Firm* — WPAT, PC

(57) ABSTRACT

A pixel architecture includes a LED, a transistor, a data receiving unit, a compensation unit, a first switching unit, a second switching unit, and a capacitor. The transistor is configured to drive the LED. The first switching unit transmits a pixel data signal to the transistor according to a first scan signal. The compensation unit transmits a reference voltage. The first switching unit transmits a supply voltage to the transistor according to a second scan signal. The second switching unit transmits the pixel data signal to the transistor according to the second scan signal or a third scan signal. The capacitor is coupled to the transistor and the data receiving unit. The pixel data signal is transmitted to the capacitor at the time that the compensation unit transmit the reference voltage to the transistor.

16 Claims, 11 Drawing Sheets

(56) References Cited

U.S. PATENT DOCUMENTS

2012/0306840 A1* 12/2012 Han ..... G09G 3/003
345/212

FOREIGN PATENT DOCUMENTS

| | | |
|---|---|---|
| TW | I252455 | 4/2006 |
| TW | I427595 | 2/2014 |

* cited by examiner

PIXEL ARCHITECTURE AND DRIVING METHOD THEREOF

RELATED APPLICATIONS

This application claims priority to Taiwan Application Serial Number 103131780, filed Sep. 15, 2014, which is herein incorporated by reference.

BACKGROUND

Technical Field

The present disclosure relates to a pixel architecture. More particularly, the present disclosure relates to a pixel architecture having threshold voltage compensation.

Description of Related Art

In general, organic light emitting elements have certain advantages including self-luminosity, wide viewing angle, high contrast, low power consumption, fast response etc., such that the organic light emitting elements have been widely utilized in flat displays. In a general active matrix organic light emitting diode (AMOLED) display, a pixel region includes an OLED and a thin-film transistor (TFT), in which the OLED is driven by the current generated from the TFT.

However, due to process variation in the fabrication of a TFT array, threshold voltages of the TFTs may be different with each other. As a result, the driving currents generated from the TFTs vary, which results in non-uniform luminance of the OLEDs, and a mura issue in displaying an image.

SUMMARY

An aspect of the present disclosure is to provide a pixel architecture. The pixel architecture includes a light emitting diode, a transistor, a data receiving unit, a compensation unit, a first switching unit, a second switching unit, and a capacitor. The transistor includes a control terminal, a first terminal and a second terminal. The second terminal of the transistor is electrically coupled to the light emitting diode, and the transistor is configured to drive the light emitting diode according to a voltage difference between the first terminal and the control terminal of the transistor. The data receiving unit is electrically coupled to the control terminal of the transistor, and is configured to transmit a pixel data signal to the control terminal of the transistor according to a first scan signal. The compensation unit is electrically coupled to the control terminal of the transistor and the data receiving unit, and is configured to provide a reference voltage to the control terminal of the transistor. The first switching unit is electrically coupled to the first terminal of the transistor, and is configured to receive a supply voltage and to transmit the supply voltage to the first terminal of the transistor according to a second scan signal. The second switching unit is electrically coupled between the control terminal of the transistor and the data receiving unit, and is configured to transmit the pixel data signal to the control terminal of the transistor according to the second scan signal or a third scan signal. The capacitor is electrically coupled to the first terminal of the transistor and the data receiving unit. The data receiving unit is configured to transmit the pixel data signal to the capacitor at a time that the compensation unit transmits the reference voltage to the control terminal of the transistor.

Another aspect of the present disclosure is to provide a driving method for driving a pixel architecture. The pixel architecture includes a light emitting diode, a data receiving unit, a transistor and a compensation unit, in which the transistor includes a first terminal, a second terminal and a control terminal. The second terminal of the transistor is electrically coupled to the light emitting diode, the data receiving unit is electrically coupled to the control terminal of the transistor, and the compensation unit is electrically coupled to the second terminal and the control terminal of the transistor. The driving method includes the following steps: transmitting a reference voltage to the control terminal of the transistor by the compensation unit; receiving a pixel data signal by the data receiving unit; electrically coupling the control terminal of the transistor to the second terminal of the transistor through the compensation unit; transmitting the pixel data signal to the control terminal of the transistor; and generating a driving current to the light emitting diode according to a voltage difference between the first terminal and the control terminal of the transistor.

Another aspect of the present disclosure is to provide a pixel architecture. The pixel architecture includes a light emitting diode, a first transistor, a second transistor, a third transistor, a fourth transistor, a fifth transistor, and a capacitor. The first transistor includes a first terminal, a second terminal electrically coupled to the light emitting diode, and a control terminal. The second transistor includes a first terminal configured to receive a pixel data signal, a second terminal electrically coupled to the control terminal of the first transistor, and a control terminal configured to receive a first scan signal, so that the pixel data signal is transmitted from the first terminal of the second transistor to the second terminal of the second transistor. The third transistor includes a first terminal electrically coupled to the control terminal of the first transistor, a second terminal electrically coupled to the light emitting diode and the second terminal of the first transistor, and a control terminal configured to receive the first scan signal, so that the first terminal of the third transistor is coupled to the second terminal of the third transistor. The fourth transistor includes a first terminal configured to receive a supply voltage, a second terminal electrically coupled to the first terminal of the first transistor, and a control terminal configured to receive a second scan signal, so that the supply voltage is transmitted to the first terminal of the first transistor. The fifth transistor includes a first terminal electrically coupled to the second terminal of the second transistor, a second terminal electrically coupled to the control terminal of the first transistor, and a control terminal configured to receive the second scan signal or a third scan signal, so that the first terminal of the fifth transistor is coupled to the second terminal of the fifth transistor. The capacitor includes a first terminal electrically coupled to the first terminal of the first transistor and a second terminal electrically coupled to the second terminal of the second transistor.

In summary, the pixel architecture and the driving method of the present disclosure can significantly reduce the variations of the driving current, and thus make a monitor display images with a uniform luminance.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
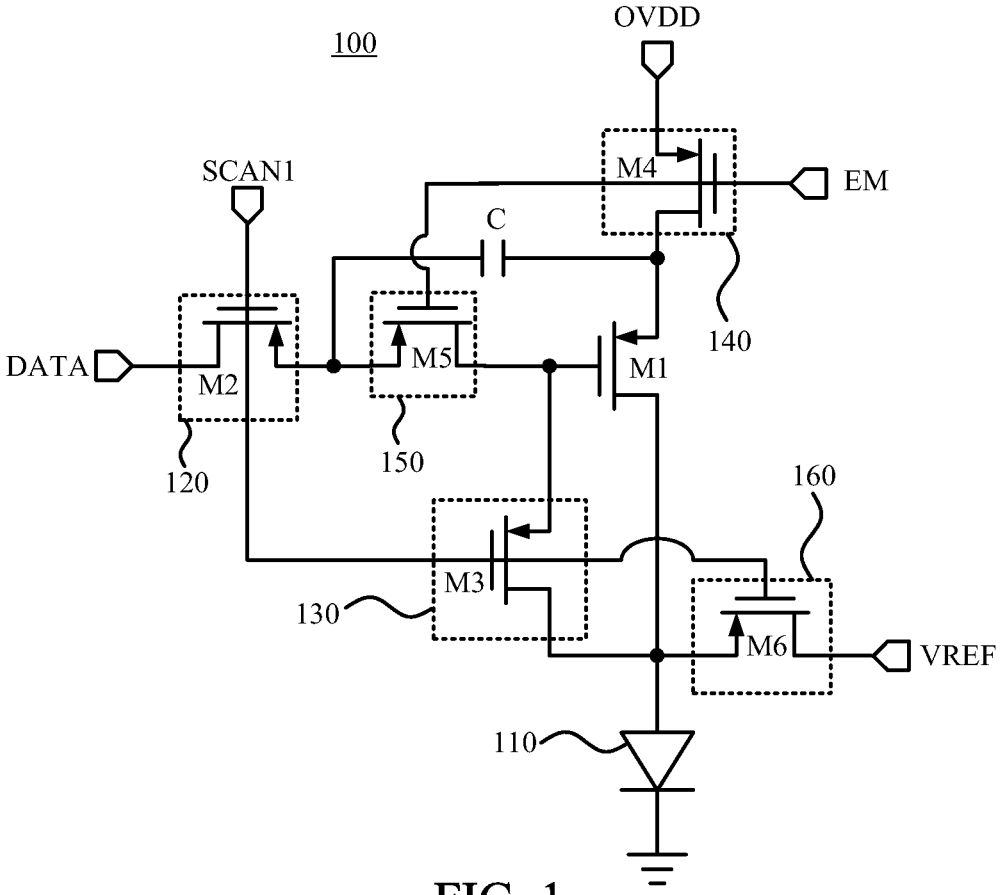
FIG. 1 is a schematic diagram of a pixel architecture according to one embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

Although the terms "first," "second," etc., may be used herein to describe various elements, these elements should not be limited by these terms. These terms are used to distinguish one element from another.

FIG. 1 is a schematic diagram of a pixel architecture according to one embodiment of the present disclosure. As shown in FIG. 1, the pixel architecture 100 includes a light emitting diode 110, a transistor M1, a data receiving unit 120, a compensation unit 130, a switching unit 140, a switching unit 150, a capacitor C and a reset unit 160.

As shown in FIG. 1, in this embodiment, the data receiving unit 120 includes a transistor M2. A first terminal of the transistor M2 is configured to receive a pixel data signal DATA, a second terminal of the transistor M2 is electrically coupled to a control terminal of the transistor M1 via the switching unit 150, and a control terminal of the transistor M2 is configured to receive a scan signal SCAN1.

Further, the compensation unit 130 includes a transistor M3. A first terminal of the transistor M3 is electrically coupled to the control terminal of the transistor M1, a second terminal of the transistor M3 is electrically coupled to a second terminal of the transistor M1, and a control terminal of the transistor M3 is configured to receive the scan signal SCAN1, so that the first terminal of the transistor M3 is able to be coupled to the second terminal of the transistor M3.

In this embodiment, the switching unit 140 includes a transistor M4. A first terminal of the transistor M4 is configured to receive a supply voltage OVDD, a second terminal of the transistor M4 is electrically coupled to the first terminal of the transistor M1, and a control terminal of the transistor M4 is configured to receive a scan signal EM. The switching unit 150 includes a transistor M5. A first terminal of the transistor M5 is electrically coupled to the second terminal of the transistor M2, a second terminal of the transistor M5 is electrically coupled to the control terminal of the transistor M1, and a control terminal of the transistor M5 is configured to receive the scan signal EM. Thus, the first terminal of the transistor M5 is able to be connected with the second terminal of the transistor M5 according to the scan signal EM.

A first terminal of the capacitor C is electrically coupled to the first terminal of the transistor M1, and a second terminal of the capacitor C is electrically coupled to the second terminal of the transistor M2. The reset unit 160 includes a transistor M6. A first terminal of the transistor M6 is electrically coupled to the second terminal of the transistor M1, a second terminal of the transistor M6 is configured to receive a reference voltage VREF, and a control terminal of the transistor M6 is configured to receive the scan signal SCAN1.

In greater detail, the transistor M2, the transistor M3, and the transistor M6 are configured to be selectively turned on according to the scan signal SCAN1. The transistor M4 and the transistor M5 are configured to be selectively turned on according to the scan signal EM. Thus, when the transistor M2 and the transistor M5 are turned on, the pixel data signal DATA is transmitted to the control terminal of the transistor M1. When the transistor M3 and the transistor M6 are turned on, the reference voltage is transmitted to the control terminal of the transistor M1. When the transistor M4 is turned on, the supply voltage OVDD is transmitted to the first terminal of the transistor M1.

Further, the second terminal of the transistor M1 is electrically coupled to the light emitting diode 110. Thus, the light emitting diode 110 is driven according to a voltage difference between the second terminal and the control terminal of the transistor M1.

In various embodiments, the transistors M1-M6 can be any type of transistor, such as metal oxide semiconductor field-effect transistor (MOSFET), thin film transistor (TFT), etc. For example, the transistor M1 is a P-type MOSFET, and the control terminal of the transistor M1 is a gate terminal, the first terminal of the transistor M1 is a source terminal, and the second terminal of the transistor M1 is a drain terminal. In the pixel architecture 100, the light emitting diode 110 is driven by a current generated from the transistor M1, in which the current is determined by a voltage difference between the gate terminal and the source terminal. In other words, the transistor M1 is able to drive the light emitting diode according to the voltage difference between the gate terminal and the source terminal.

Figure 2:
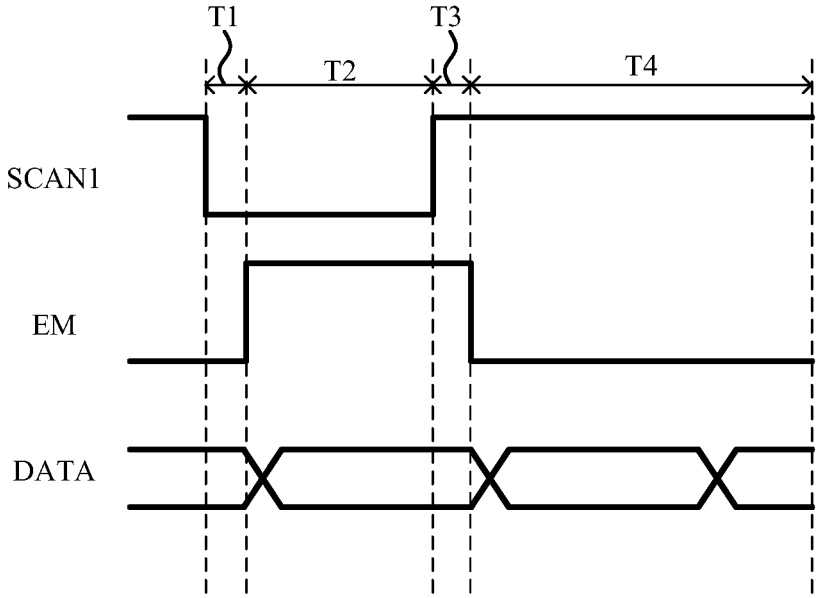
FIG. 2 is timing diagram illustrating various scan signals and the pixel data signal in the pixel architecture shown in FIG. 1, according to one embodiment of the present disclosure.

FIG. 2 is timing diagram illustrating various scan signals and the pixel data signal in the pixel architecture shown in FIG. 1, according to one embodiment of the present disclosure. FIGS. 3A-3D are schematic diagrams illustrating operations of the pixel architecture shown in FIG. 1, during different periods, according to one embodiment of the present disclosure. FIG. 4 is a flow chart of a driving method according to one embodiment of the present disclosure. For simplicity, reference is made to FIG. 2, FIGS. 3A-3D, and FIG. 4, and the operations of the pixel architecture 100 are described with the driving method 400.

The driving method includes step S420, step S440, step S460, and step S480. In step S420, the reference voltage VREF is transmitted to the control terminal and the second terminal of the transistor M1 by the compensation unit 130.

Figure 3A:
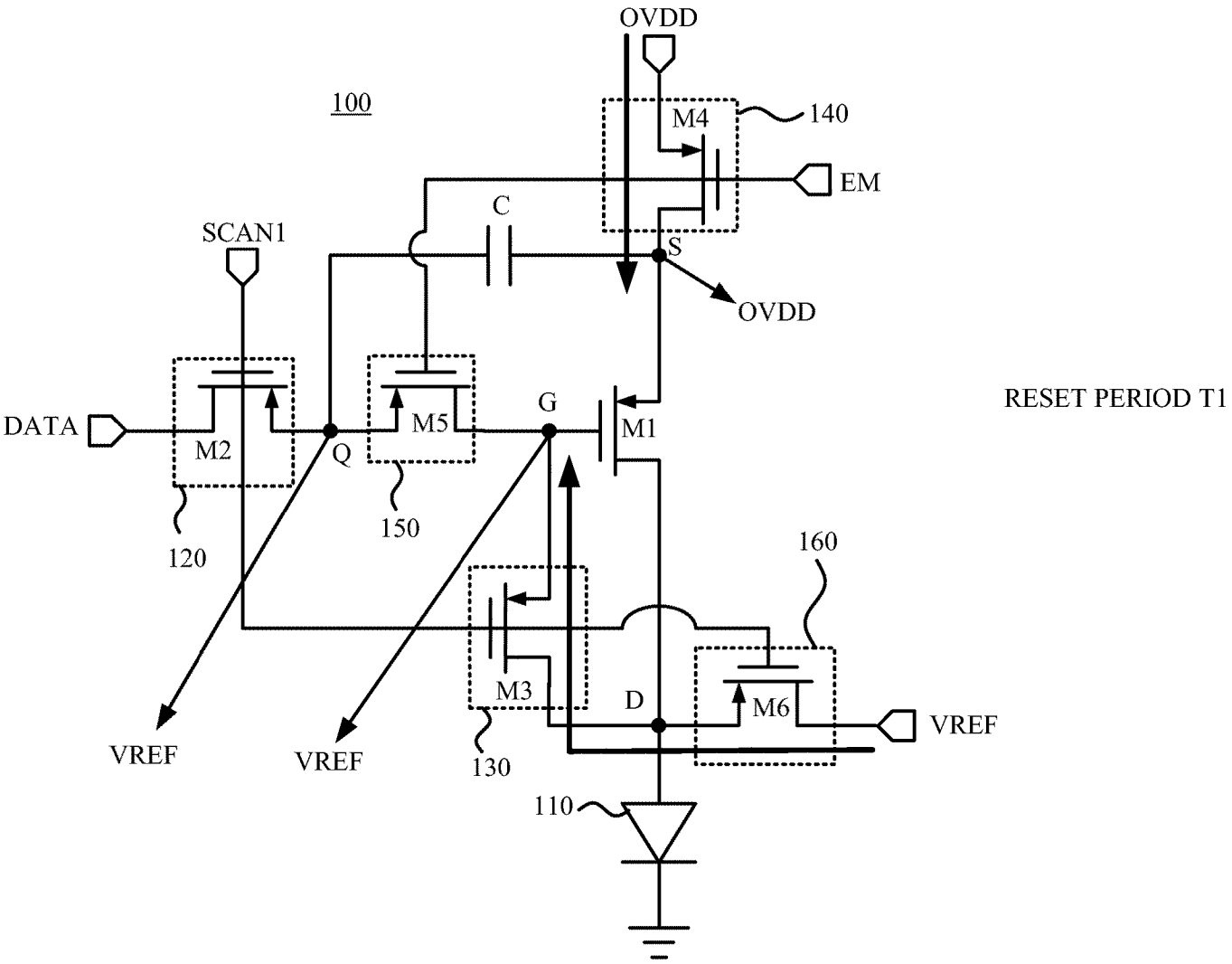
FIGS. 3A-3D are schematic diagrams illustrating operations of the pixel architecture shown in FIG. 1, during different periods, according to one embodiment of the present disclosure.
Figure 4:
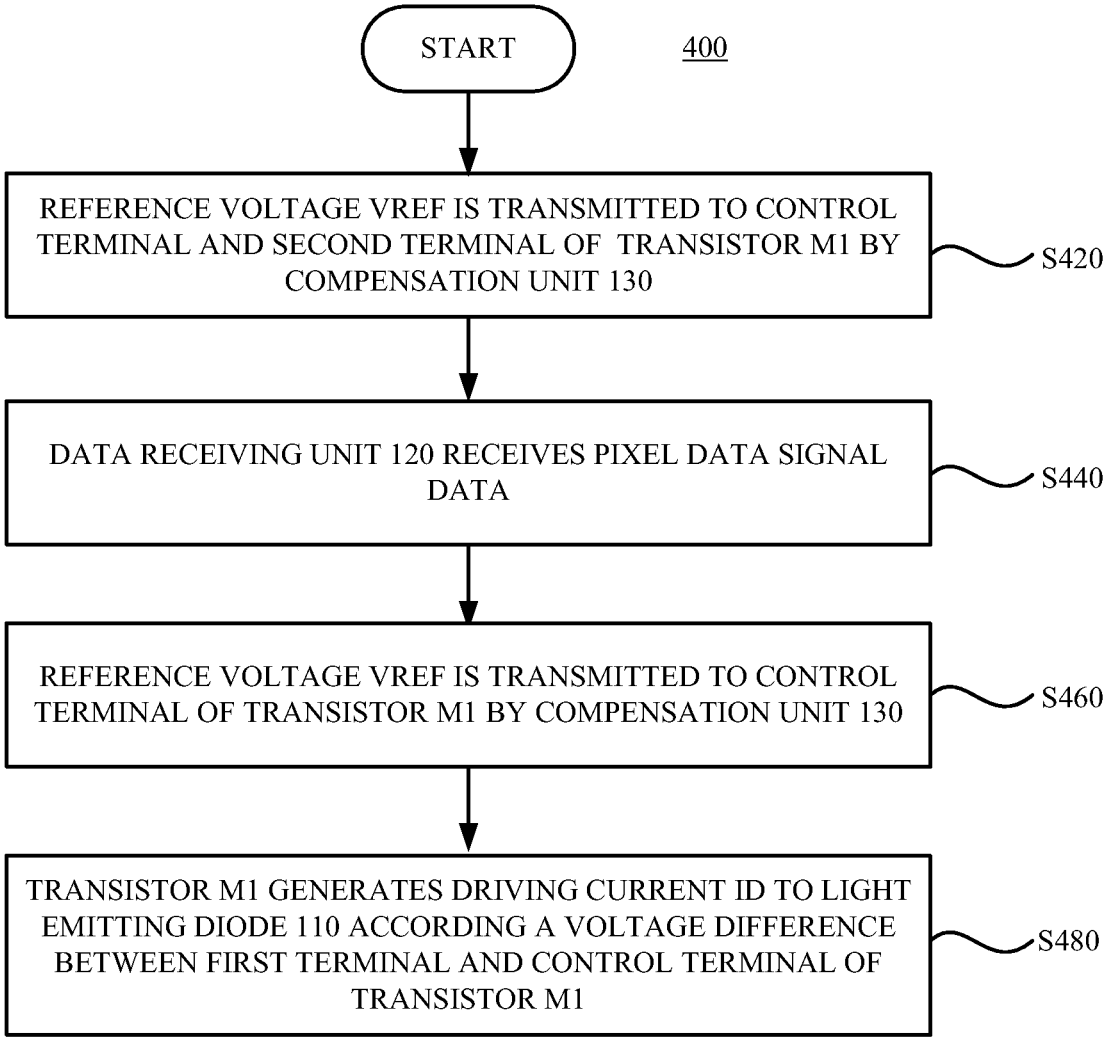
FIG. 4 is a flow chart of a driving method according to one embodiment of the present disclosure.

For example, as shown in FIG. 2 and FIG. 3A, during period T1 (referred to as a reset period), the scan signal SCAN1 is at a low level, and the scan signal EM is also at the low level. Thus, all of the transistors M1-M6 are turned on. As a result, the reference voltage VREF is transmitted to the control terminal of the transistor M1 (referred to as a node G) through the transistor M6 and the transistor M3. Accordingly, the voltage level of the node G is reset to the reference voltage VREF, and thus the transistor M1 is turned on. Similarly, the supply voltage OVDD is transmitted to the first terminal of the transistor M1 (referred to as a node S) through the transistor M4, and the voltage level of the node S is pulled up to the supply voltage OVDD. Further, during period T1, the reference voltage VREF is also transmitted to the second terminal of the transistor M1 (referred to as a node D), and the light emitting diode 110 is thus reverse-biased. With the configuration of the reset period T1, the pixel architecture 100 is able to reset electrical charges left from previous operations. As a result, a much better effect of voltage compensation is obtained.

In step S440, the data receiving unit 120 receives the pixel data signal DATA. In step S460, the reference voltage VREF is transmitted to the control terminal of the transistor M1 by the compensation unit 130.

Figure 3B:
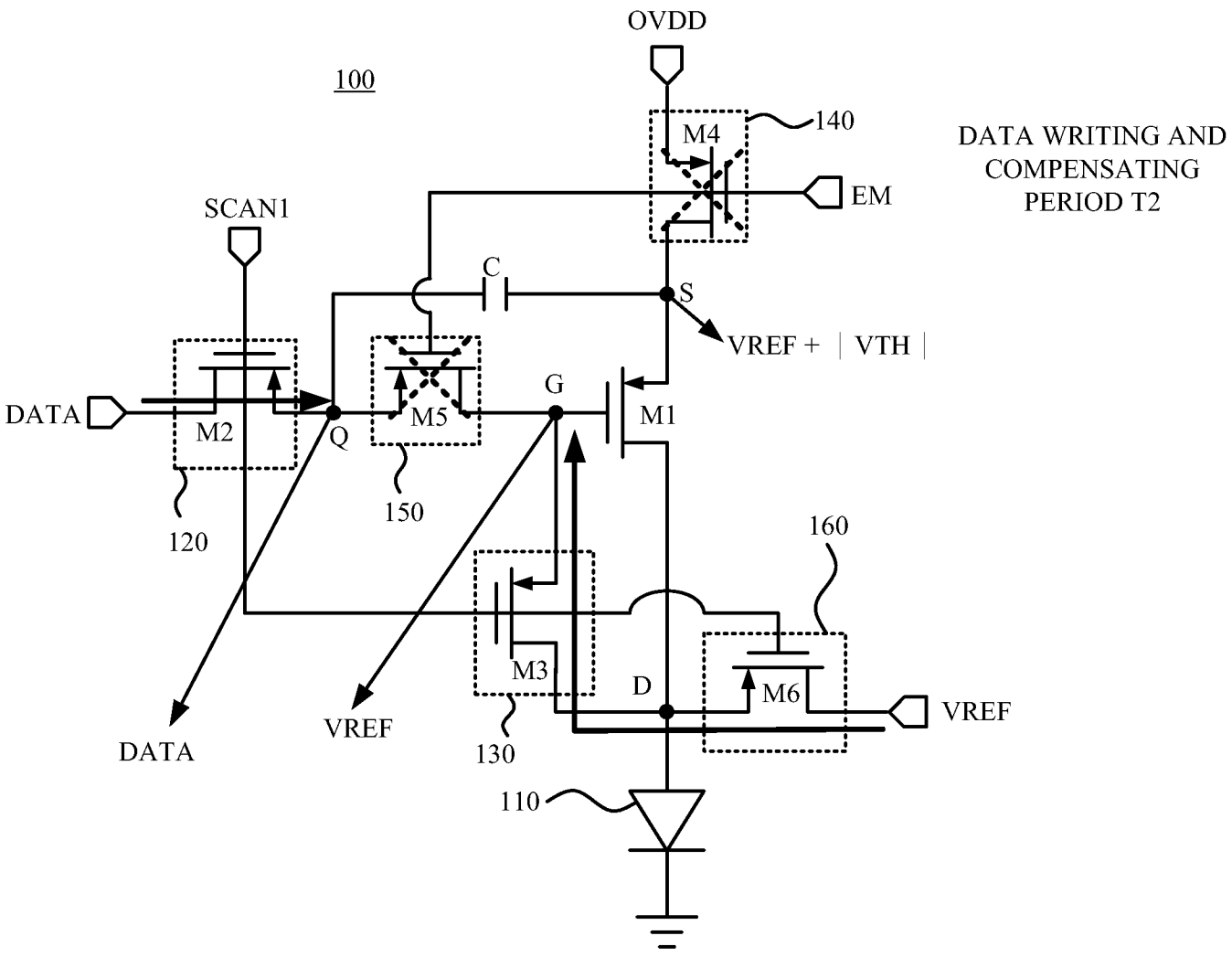
Figure 3C:
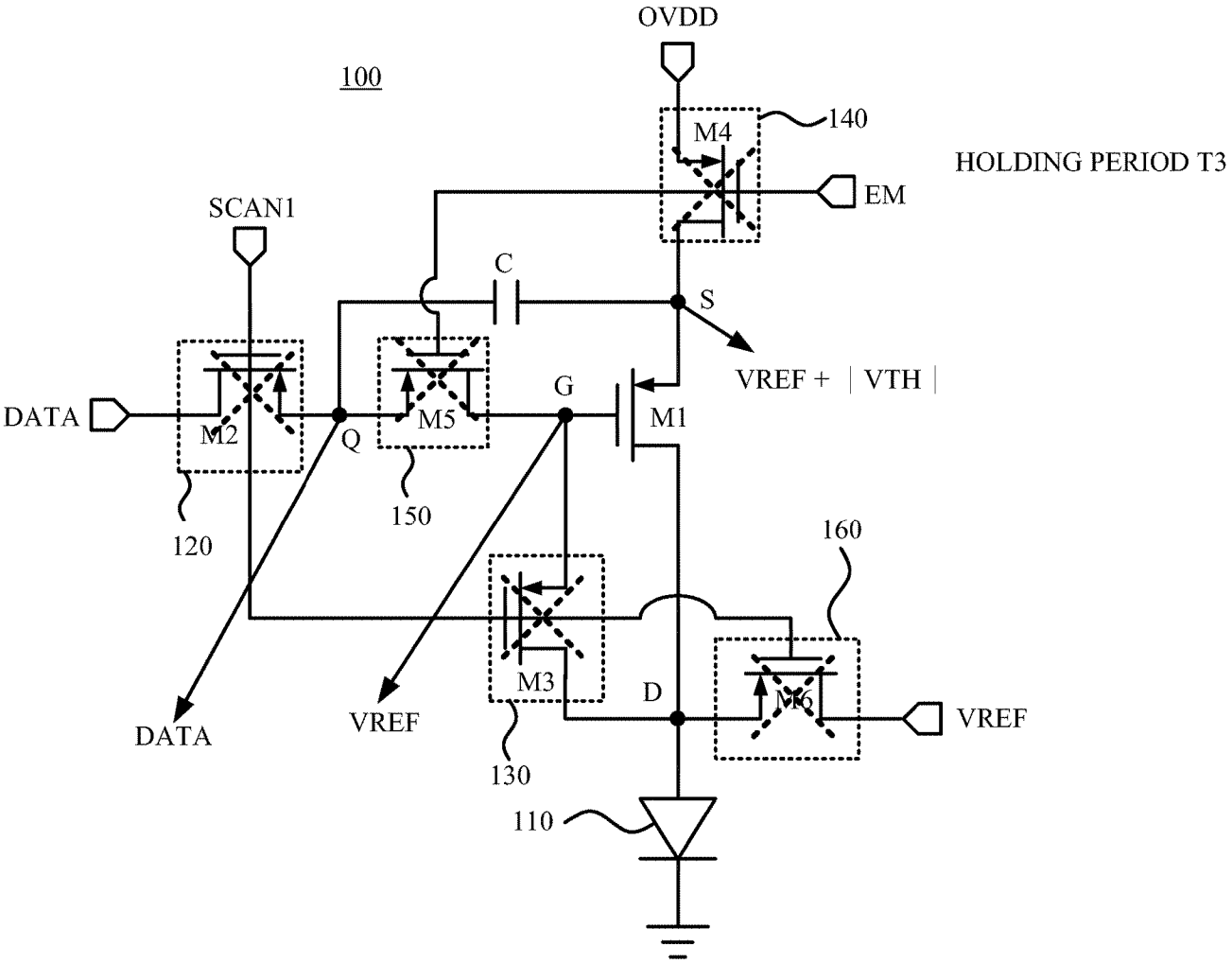

For example, as shown in FIG. 2 and FIG. 3B, during period T2 (referred to as a data writing and compensating period), the scan signal SCAN1 keeps being at the low level, and the scan signal EM switches to a high level. Thus, the transistor M2, the transistor M3, and the transistor M6 are turned on, and the transistor M4 and the transistor M5 are turned off. In this time, the reference voltage VREF is still transmitted to the node G through the transistor M6 and the transistor M3, and thus the transistor M1 is turned on. Similarly, the reference voltage VREF is still transmitted to the node D through the transistor M6 and the transistor M3, and thus the light emitting diode 110 is still reverse-biased. During period T2, the transistor M1 forms a diode-connected circuit, i.e., the second terminal of the transistor M1 is coupled to the control terminal of the transistor M1. As the voltage level of the node G (i.e., the first terminal of the transistor M1) is maintained at the reference voltage VREF, the voltage level of the node S (i.e., the first terminal of the transistor M1) is pulled to VREF+|VTH|, in which VTH is a threshold voltage of the transistor M1.

In other words, during the data writing and compensating period T2, the data receiving unit 120 (i.e., transistor M2) transmits the pixel data signal DATA to the capacitor C. In the mean time, the compensation unit 130 transmits the reference voltage VREF to the control terminal of the transistor M1 (i.e., node G). With such configuration, during the same period, the node Q (i.e., one terminal of the capacitor C) is able to store the pixel data signal DATA, and the node S (i.e., another one terminal of the capacitor C) is able to store the threshold voltage VTH of the transistor M1 at the same time.

Afterwards, as shown in FIG. 2, during period T3 (referred to as a holding period), the scan signal SCAN1 is switched to the high level, and the scan signal EM keeps being at the high level. In this time, the transistor M2-M6 are turned off, and the voltage levels of the node G, the node D, the node S, and the node Q of the pixel architecture 100 are maintained. By setting the period T3, the node S can have an enough time for storing the threshold voltage VTH, and thus a much better effect of voltage compensation can be obtained. It's understood that, in some other embodiments, the pixel architecture 100 can perform lighting operation without setting the holding period T3. In other words, in some other embodiments, the time for the scan signal SCAN1 switching from the low level to the high level is same as the time for the scan signal EM switching from the high level to the low level.

In step S480, the transistor M1 generates a driving current ID to the light emitting diode 110 according a voltage difference between the first terminal and the control terminal of the transistor M1.

Figure 3D:
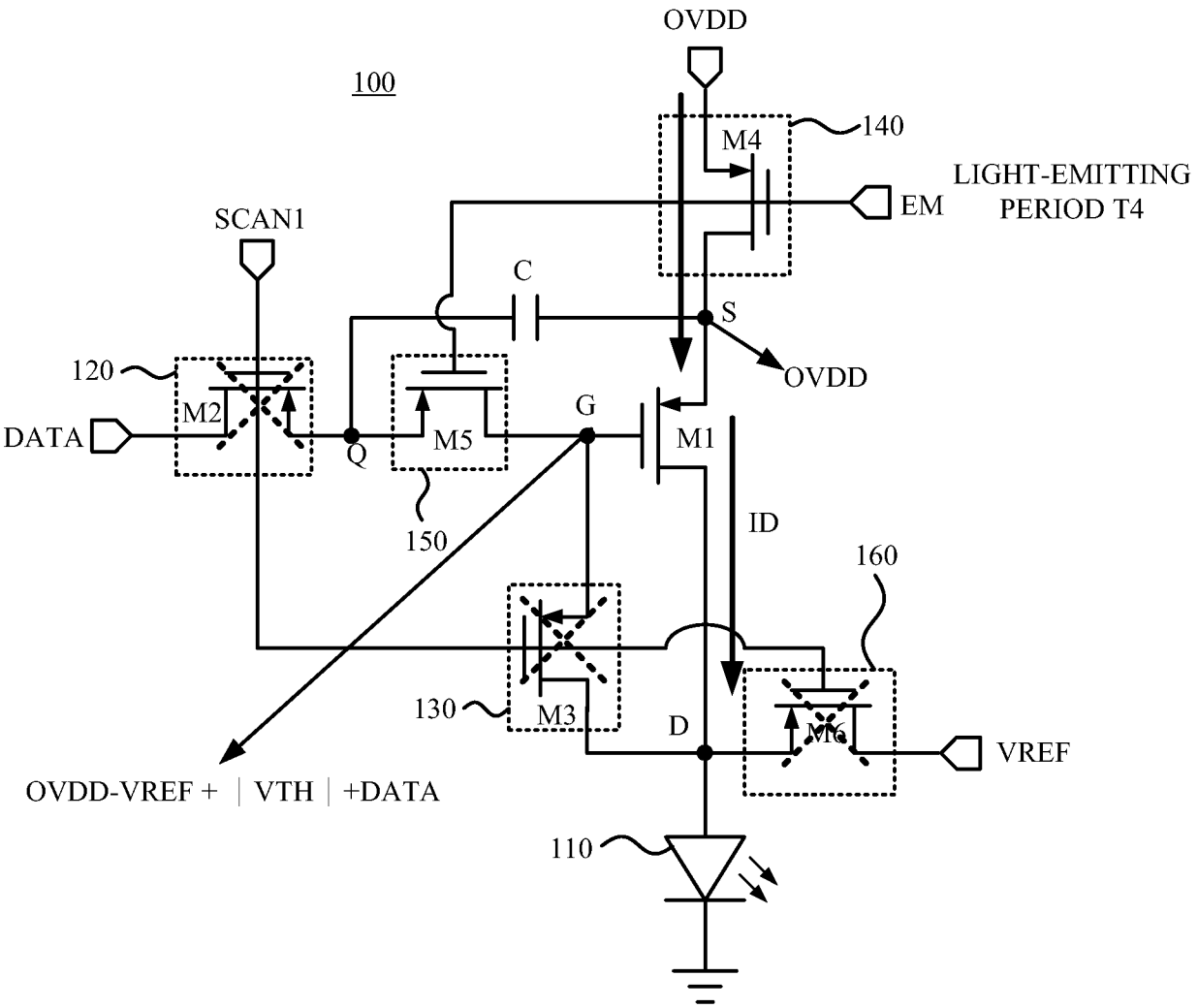

For example, as shown in FIG. 2 and FIG. 3D, during period T4 (referred to as a light-emitting period), the scan signal SCAN1 keeps being at the high level, and the scan signal EM switches to the low level. Thus, the transistor M1, the transistor M4, and the transistor M5 are turned on, and the transistor M2, the transistor M3, and the transistor M6 are turned off. In this time, the voltage level of the node S is pulled from VREF+|VTH| to the supply voltage OVDD. In other words, the voltage variation on the node S is OVDD−(VREF+|VTH|). Due to characteristics of the capacitor C, the voltage level of the node Q is changed from DATA to OVDD−(VREF+|VTH|)+DATA. During period T4, the node Q is coupled to the node G through the transistor M5. Thus, the voltage level of the node G is OVDD−(VREF+|VTH|)+DATA.

Accordingly, during the light-emitting period T4, the transistor M4, the transistor M1, and the light emitting diode 110 form a conducting path, the transistor M1 generates the driving current ID to drive the light emitting diode 110, and thus makes the light emitting diode 110 illuminate. At this time, the driving current ID can be derived from the following equation:

$$\begin{aligned} ID &= K\cdot(VSG-|VTH|)^2 \\ &= K\cdot(VS-VG-|VTH|)^2 \\ &= K\cdot\{OVDD-[OVDD-(VREF+|VTH|)+DATA]-|VTH|\}^2 \\ &= K\cdot(VREF-DATA)^2 \end{aligned}$$

K is a process parameter of the transistor M1. VSG is the voltage difference between the node S and the node G. VS is the voltage level of the node S, i.e., OVDD. VG is the voltage level of the node G, i.e., OVDD−(VREF+|VTH|). From the above equations, the driving current ID is not directly related to the supply voltage OVDD and the threshold VTH of the transistor M1. As a result, a variation between the driving current ID of each of the pixel architecture 100, caused by a voltage drop on the supply voltage OVDD, or a variation of the threshold voltage VTH of the transistor M1 of each of the pixel architecture 100 under process variation conditions, can be avoided.

Figure 5:
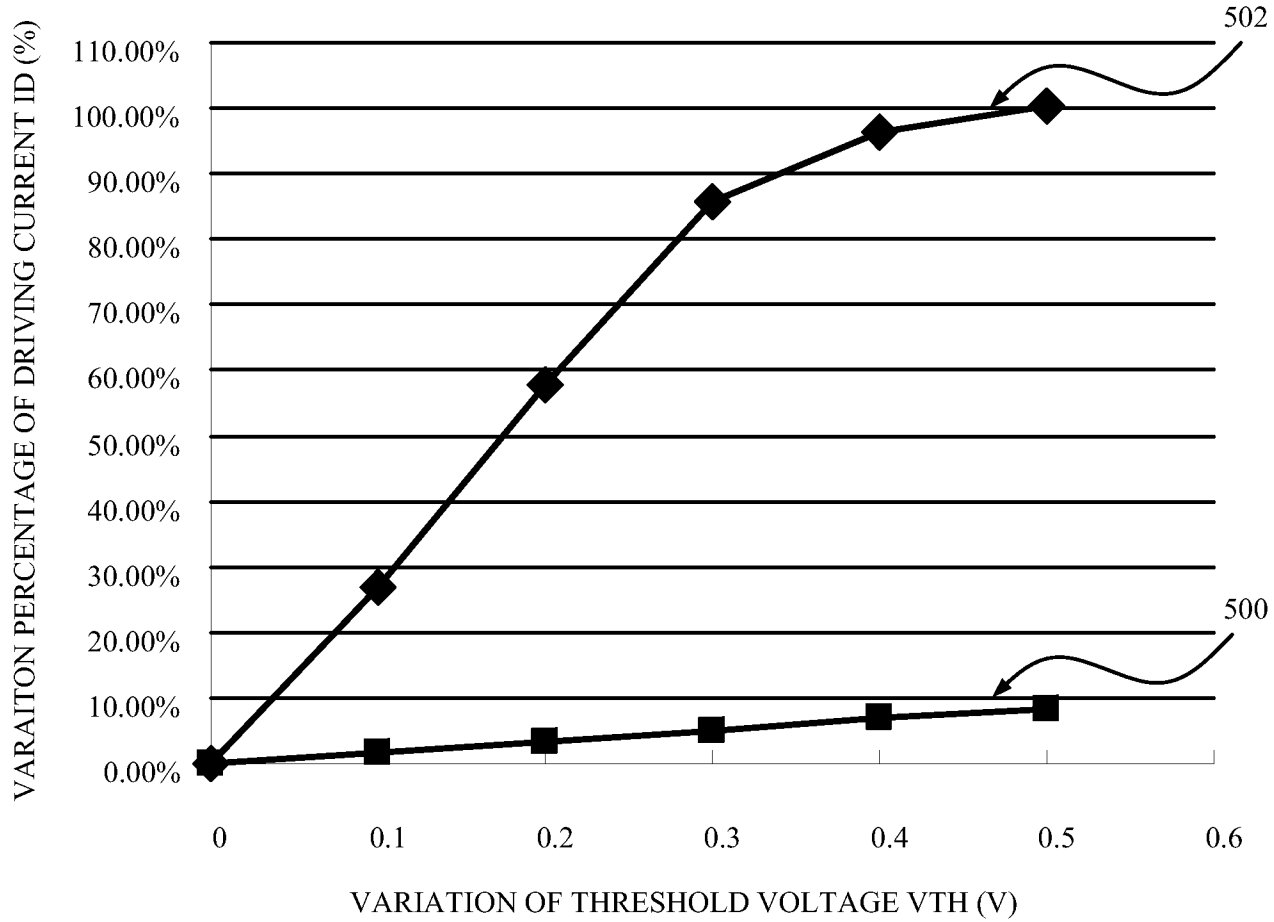
FIG. 5 is a measurement result of a variation percentage of the driving current when the transistor of the pixel architecture as shown in FIG. 1 has different threshold voltages.

FIG. 5 is a measurement result of a variation percentage of the driving current when the transistor of the pixel architecture as shown in FIG. 1 has different threshold voltages. In FIG. 5, the curve 500 indicates the variation percentage of the driving current when the transistor of the pixel architecture 100 in FIG. 1 has different threshold voltages VTH, and the curve 520 indicates the variation percentage of the driving current when the transistor of pixel architecture (2T1C) used in some approaches has different threshold voltages VTH. As shown in FIG. 5, under the conditions that the variation of the threshold voltage VTH is 0-0.5 volts (V), compared with the pixel architecture having 2T1C, the variation of the driving current ID of the pixel architecture 100 of the present disclosure is much lower.

Figure 6A:
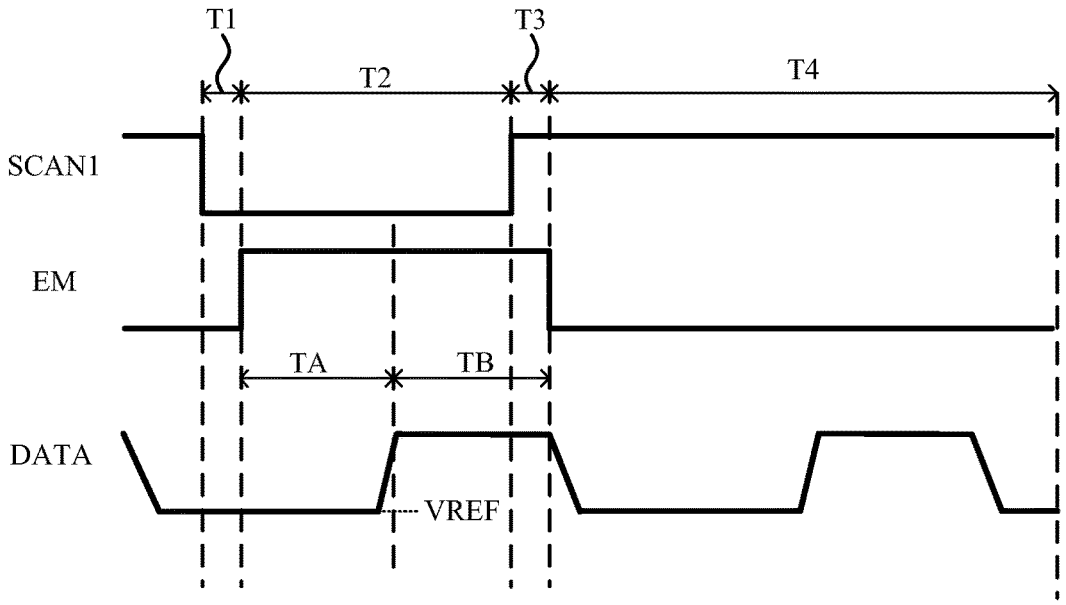
FIG. 6A is timing diagram illustrating various scan signals and the pixel data signal in the pixel architecture shown in FIG. 1, according to another one embodiment of the present disclosure.
Figure 6B:
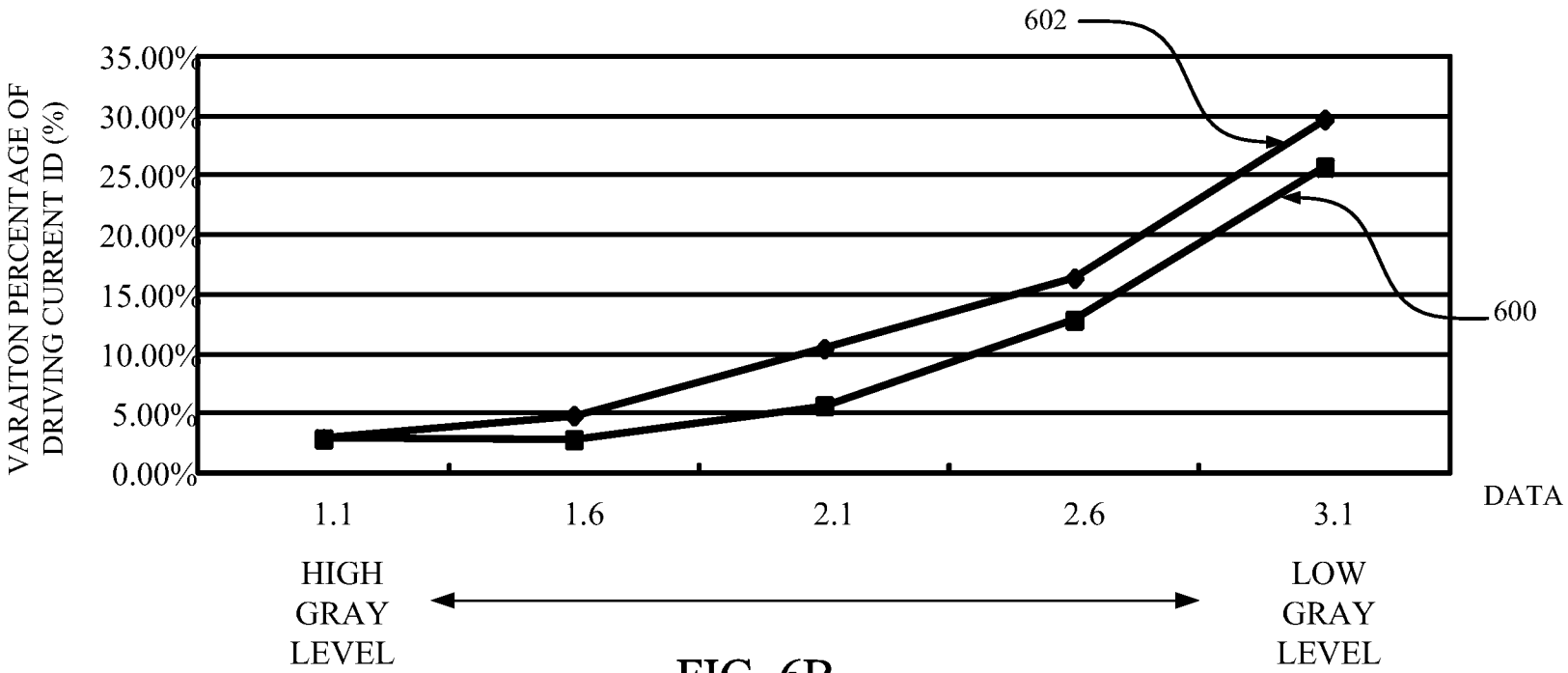
FIG. 6B is a measurement result of a variation percentage of the driving current when the transistor of the pixel architecture as shown in FIG. 1 has different threshold voltages.

FIG. 6A is timing diagram illustrating various scan signals and the pixel data signal in the pixel architecture shown in FIG. 1, according to another one embodiment of the present disclosure. FIG. 6B is a measurement result of a variation percentage of the driving current when the transistor of the pixel architecture as shown in FIG. 1 has different threshold voltages.

Compared with FIG. 2, when the pixel data signal DATA in FIG. 6A enters the data writing and compensating period T2, the voltage level of the pixel data signal DATA in the period TA is set to the level of the reference voltage VREF, and the voltage level of the pixel data signal DATA in the period TB is set to a desired pixel data value. In other words, in this embodiment, during the period that the switching unit 150 is turned off by the scan signal EM, the pixel data signal DATA is configured to be at the lower voltage level in the period TA, and to be at the higher voltage level in the period TB.

Accordingly, during the period TB, when the pixel data signal DATA is at the high voltage level, the voltage level of the node Q is increased. Due to the characteristics of the capacitor C, the voltage level of the node S is also increased, and thus the current of the transistor M1 is increased at this time. Therefore, the voltage level VS of the node S is discharged with a higher current during the period TB, and thus the voltage level VS can be quickly and accurately pulled down to VREF+|VTH|. Compared with the configurations of FIG. 2, by using a higher discharging current, the voltage level VS in this embodiment can store the threshold voltage |VTH| with much more accuracy.

In FIG. 6B, the curve 600 indicates the variation percentage of the driving current when the pixel architecture in FIG. 1 operates in the timing shown in FIG. 6A with different pixel data signals, and the curve 602 indicates the variation percentage of the driving current when the pixel architecture in FIG. 1 operates in the timing shown in FIG. 2 with different pixel data signals. As shown in FIG. 6B, compared with the above embodiments, in this embodiment, the effect of the voltage compensation of the pixel architecture 100 can be further improved.

Figure 7A:
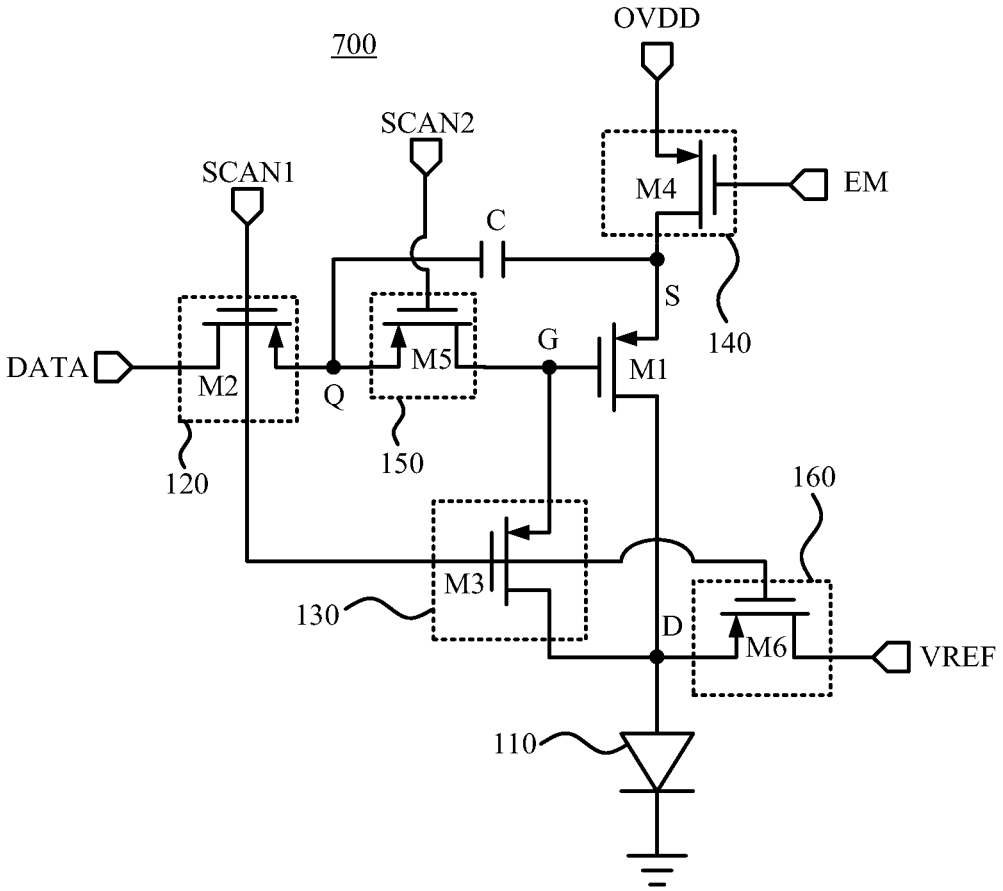
FIG. 7A is a schematic diagram of a pixel architecture, according to another one embodiment of the present disclosure.
Figure 7B:
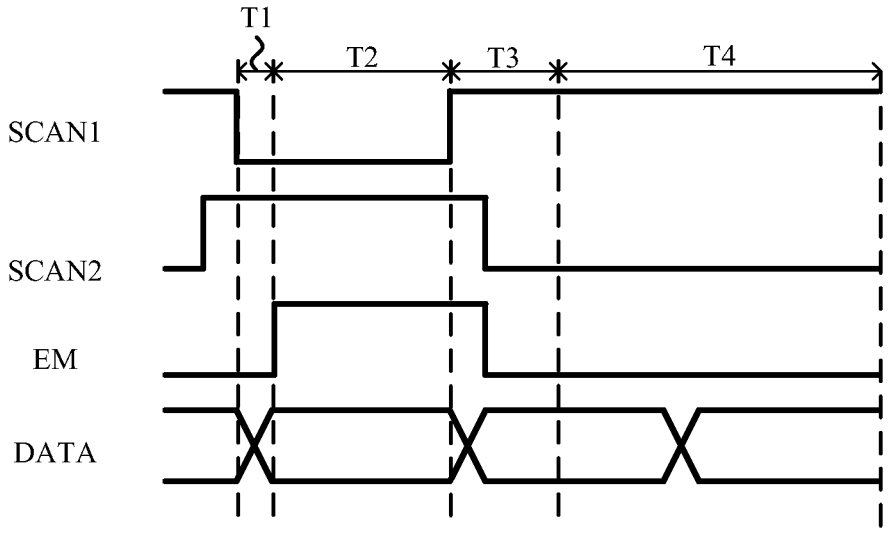
FIG. 7B is timing diagram illustrating various scan signals and the pixel data signal in the pixel architecture shown in FIG. 7A, according to one embodiment of the present disclosure.

FIG. 7A is a schematic diagram of a pixel architecture, according to another one embodiment of the present disclosure. FIG. 7B is timing diagram illustrating various scan signals and the pixel data signal in the pixel architecture shown in FIG. 7A, according to one embodiment of the present disclosure.

Compared with FIG. 1, the switching unit 150 of the pixel architecture 700 is configured to be selectively turned on according the scan signal SCAN2. In other words, in this embodiment, the transistor M5 is configured to transmit the pixel data signal DATA to the control terminal of the transistor M1 according to the scan signal SCAN2. As shown in FIG. 7B, the scan signal SCAN2 is configured to turn off the switching unit 150 (i.e., the transistor M5) before the data receiving unit 120 (i.e., the transistor M2) is turned on by the scan signal SCAN1. As a result, during the reset period T1, the control terminal of the transistor M1 (i.e., node G) can be reset to the reference voltage VREF without the affect from the voltage level of the node Q. The operations of the pixel architecture 700 are similar with the operations of the pixel architecture 100, and thus the repetitious descriptions are not given here.

Figure 8:
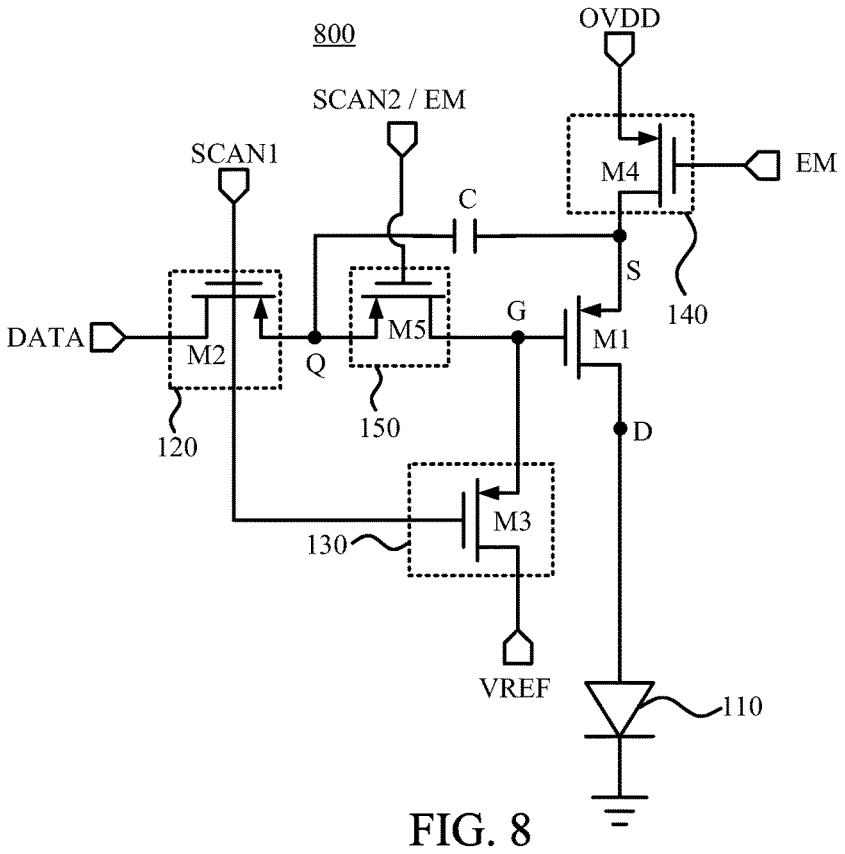
FIG. 8 is a schematic diagram of a pixel architecture according to one embodiment of the present disclosure.

FIG. 8 is a schematic diagram of a pixel architecture according to one embodiment of the present disclosure. Compared with the pixel architecture 700 shown in FIG. 7, the reset unit 160 is not presented in the pixel architecture 800. In other words, the compensation unit 130 of the pixel architecture 800 is configured to directly receive the reference voltage VREF.

In greater detail, in this embodiment, the second terminal of the transistor M3 is configured to receive the reference voltage VREF. With such configuration, in some applications without the need of reset operations, the layout space of the pixel architecture 800 can be increased. Further, as mentioned above, the transistor M5 of the pixel architecture 800 is configured to be selectively turned on according to the scan signal EM or the scan signal SCAN2. When the transistor M5 is configured to be turned on according to the scan signal EM, the timing diagram for the operations of the pixel architecture 800 is same as FIG. 2. When the transistor M5 is configured to be turned on according to the scan signal scan 2, the timing diagram for the operations of the pixel architecture 800 is same as FIG. 7B. As the operations of the pixel architecture 800 are similar with the operations of the pixel architecture 100, the repetitious descriptions are not given here.

Figure 9:
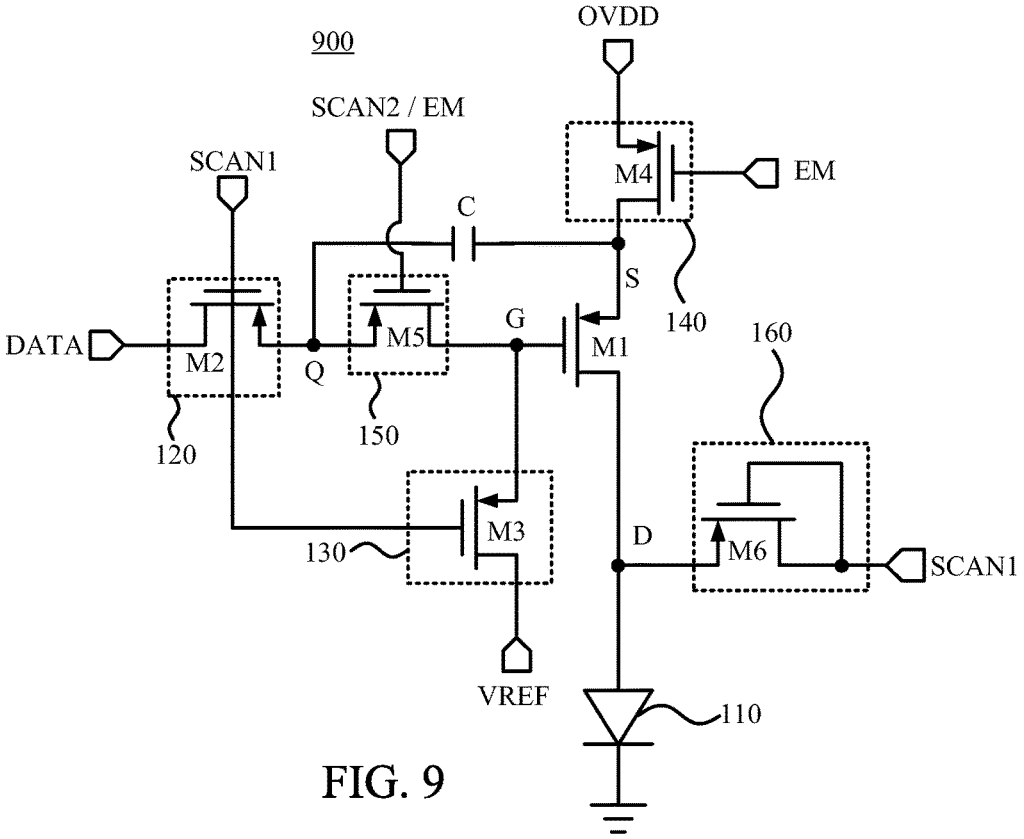
FIG. 9 is a schematic diagram of a pixel architecture according to one embodiment of the present disclosure.

FIG. 9 is a schematic diagram of a pixel architecture according to one embodiment of the present disclosure. Compared with the pixel architecture 100 in FIG. 1, the reset unit 160 of the pixel architecture 900 is configured to be selectively turned on according to the scan signal SCAN1, so as to reset the light emitting diode 110.

In greater detail, as shown in FIG. 9, the first terminal of the transistor M6 is electrically couple to the control terminal of the transistor M6, and the control terminal of the transistor M6 is configured to receive the scan signal SCAN1. With such configuration, the light emitting diode 110 is able to be reset, and the reset operation is independent to the reference voltage VREF.

As mentioned above, the transistor M5 of the pixel architecture 900 is configured to be selectively turned on according to the scan signal EM or the scan signal SCAN2. When the transistor M5 is configured to be turned on according to the scan signal EM, the timing diagram for the operations of the pixel architecture 900 is same as FIG. 2. When the transistor M5 is configured to be turned on according to the scan signal scan 2, the timing diagram for the operations of the pixel architecture 900 is same as FIG. 7B. As the operations of the pixel architecture 900 are similar with the operations of the pixel architecture 100, the repetitious descriptions are not given here.

For illustrative purposes, the pixel architectures in the embodiments above are given with P-type transistor. Various types of the transistors and the corresponding arrangements are within the contemplated scope of the present disclosure.

In summary, the pixel architecture and the driving method of the present disclosure can significantly reduce the variations of the driving current, and thus make a monitor display images with a uniform luminance.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A pixel architecture, comprising:

a light emitting diode;

a transistor comprising a control terminal, a first terminal and a second terminal, wherein the second terminal of the transistor is electrically coupled to the light emitting diode, and the transistor is configured to drive the light emitting diode according to a voltage difference between the first terminal and the control terminal of the transistor;

a data receiving unit electrically coupled to the control terminal of the transistor, and configured to transmit a pixel data signal to the control terminal of the transistor according to a first scan signal;

a compensation unit electrically coupled to the control terminal of the transistor and the data receiving unit, and configured to transmit a reference voltage to the control terminal of the transistor according to the first scan signal;

a first switching unit electrically coupled to the first terminal of the transistor, and configured to receive a supply voltage and to transmit the supply voltage to the first terminal of the transistor according to a second scan signal;

a second switching unit electrically coupled between the control terminal of the transistor and the data receiving unit, configured to transmit the pixel data signal to the control terminal of the transistor according to the second scan signal or a third scan signal; and a capacitor electrically coupled to the first terminal of the transistor and the data receiving unit; and a reset unit configured to be turned on according to the first scan signal, so as to reverse-bias the light emitting diode, wherein the data receiving unit is configured to transmit the pixel data signal to the capacitor at a time that the compensation unit transmits the reference voltage to the control terminal of the transistor.

2. The pixel architecture of claim 1, further comprising:

the reset unit is further configured to receive the reference voltage, and to be turned on to transmit the reference voltage to the light emitting diode according to the first scan signal, wherein the reset unit is configured to transmit the reference voltage to the compensation unit.

3. The pixel architecture of claim 1, wherein the compensation unit is further configured to receive the reference voltage.

4. The pixel architecture of claim 1, wherein when the second switching unit is turned off by the second scan signal, the pixel data signal is at a low voltage level during a first period, and a high voltage level during a second period, wherein the first period is followed by the second period.

5. A driving method for driving a pixel architecture, the pixel architecture comprising a light emitting diode, a data receiving unit, a transistor and a compensation unit, the transistor comprising a first terminal, a second terminal and a control terminal, the second terminal being electrically coupled to the light emitting diode, the data receiving unit being electrically coupled to the control terminal of the transistor, the compensation unit being electrically coupled to the second terminal and the control terminal of the transistor, and the driving method comprising:

transmitting a reference voltage to the control terminal of the transistor by the compensation unit according to a first scan signal;

receiving a pixel data signal by the data receiving unit according to the first scan signal;

electrically coupling the control terminal of the transistor to the second terminal of the transistor through the compensation unit;

transmitting the pixel data signal to the control terminal of the transistor; and generating a driving current to the light emitting diode according to a voltage difference between the first terminal and the control terminal of the transistor, wherein the pixel architecture further comprises a reset unit electrically coupled to the second terminal of the transistor, the compensation unit, and the light emitting diode, and the driving method further comprises:

receiving and transmitting the reference voltage to the second terminal of the transistor according to the first scan signal by the reset unit, so as to reverse-bias the light emitting diode, and to transmit the reference voltage to the compensation unit.

6. The driving method of claim 5, wherein the pixel architecture further comprises a first switching unit, and the driving method further comprises:

transmitting a supply voltage to the first terminal of the transistor according to a second scan signal by the first switching unit.

7. The driving method of claim 5, wherein the pixel architecture further comprises a second switching unit, and the driving method further comprises:

transmitting the pixel data signal received by the data receiving unit to the control terminal of the transistor according to a second scan signal by the second switching unit.

8. The driving method of claim 7, further comprising:

configuring the pixel data signal to be at a low voltage level during a first period and to be at a high voltage level during a second period, when the second switching unit is turned off by the second scan signal, wherein the first period is followed by the second period.

9. A pixel architecture, comprising:

a light emitting diode;

a first transistor comprising:

a first terminal;

a second terminal electrically coupled to the light emitting diode; and a control terminal;

a second transistor comprising:

a first terminal;

a second terminal electrically coupled to the control terminal of the first transistor; and a control terminal;

a third transistor configured to transmit a reference voltage to the control terminal of the first transistor, comprising:

a first terminal electrically coupled to the control terminal of the first transistor;

a second terminal electrically coupled to the light emitting diode and the second terminal of the first transistor; and a control terminal;

a fourth transistor comprising:

a first terminal;

a second terminal electrically coupled to the first terminal of the first transistor; and a control terminal;

a fifth transistor comprising:

a first terminal electrically coupled to the second terminal of the second transistor;

a second terminal electrically coupled to the control terminal of the first transistor; and a control terminal; and a capacitor, comprising:

a first terminal electrically coupled to the first terminal of the first transistor; and a second terminal electrically coupled to the second terminal of the second transistor.

10. The pixel architecture of claim 9, further comprising:

a sixth transistor, comprising:

a first terminal configured to receive the reference voltage;

a second terminal electrically coupled to the second terminal of the first transistor, the second terminal of the third transistor, and the light emitting diode; and a control terminal configured to receive a first scan signal, so that the reference voltage is transmitted from the first terminal of the sixth transistor to the second terminal of the sixth transistor.

11. The pixel architecture of claim 9, wherein the first terminal of the second transistor is configured to receive a pixel data signal and the control terminal of the second transistor is configured to receive a first scan signal, so that the pixel data signal is transmitted from the first terminal of the second transistor to the second terminal of the second transistor.

12. The pixel architecture of claim 11, wherein the control terminal of the third transistor is configured to receive the first scan signal, so that the first terminal of the third transistor is coupled to the second terminal of the third transistor.

13. The pixel architecture of claim 12, wherein the first terminal of the fourth transistor is configured to receive a supply voltage and the control terminal of the fourth transistor is configured to receive a second scan signal, so that the supply voltage is transmitted to the first terminal of the first transistor.

14. The pixel architecture of claim 13, wherein the control terminal of the fifth transistor is configured to receive the second scan signal or a third scan signal, so that the first terminal of the fifth transistor is coupled to the second terminal of the fifth transistor.

15. The pixel architecture of claim 14, further comprising:

a sixth transistor, comprising:

a first terminal configured to receive the reference voltage;

a second terminal electrically coupled to the second terminal of the first transistor, the second terminal of the third transistor, and the light emitting diode; and a control terminal configured to receive the first scan signal, so that the reference voltage is transmitted from the first terminal of the sixth transistor to the second terminal of the sixth transistor.

16. The pixel architecture of claim 14, further comprising:

a sixth transistor, comprising:

a first terminal configured to receive the first scan signal;

a second terminal electrically coupled to the second terminal of the first transistor and the light emitting diode; and a control terminal electrically coupled to the first terminal of the sixth transistor.

* * * * *